US005848452A

United States Patent [19]

Lappalainen et al.

[11] Patent Number: 5,848,452

[45] Date of Patent: Dec. 15, 1998

[54] ROLL CLEANING APPARATUS

[75] Inventors: Teuvo Lappalainen, deceased, late of Kerava; Timo Vuorimies, Järvenpää, both of Finland

[73] Assignee: Valmet Corporation, Helsinki, Finland

[21] Appl. No.: 341,388

[22] Filed: Nov. 17, 1994

[30] Foreign Application Priority Data

Nov. 18, 1993 [FI] Finland ..... 935112

[51] Int. Cl.[6] ..... B05C 9/12

[52] U.S. Cl. ..... 15/256.51; 15/256.5

[58] Field of Search ..... 15/256.5, 256.51, 15/302; 118/203, 261, 413; 162/199, 272

[56] References Cited

U.S. PATENT DOCUMENTS

| | | | |
|---|---|---|---|
| 1,317,100 | 9/1919 | Plant | 15/256.51 |
| 3,780,396 | 12/1973 | Werner | 15/256.51 |
| 3,952,650 | 4/1976 | Lotte . | |
| 4,080,059 | 3/1978 | Tani | 15/256.51 |
| 4,791,879 | 12/1988 | Eklund et al. | 118/413 |
| 5,328,511 | 7/1994 | Beisswanger | 15/156.51 |
| 5,454,870 | 10/1995 | Sieberth | 15/256.51 |

FOREIGN PATENT DOCUMENTS 921194 9/1993 Finland .

*Primary Examiner*—Terrence Till
*Attorney, Agent, or Firm*—Cohen, Pontani, Lieberman, Pavane

[57] ABSTRACT

An apparatus for cleaning the surface of a backing roll in a coater or a calender roll, wherein the roll is cleaned by spraying water on it and then scraping the water away from the surface or the roll with a doctor blade. Splashing of the water accumulating in front of the doctor blade is prevented by a rubber sheet extending down close to the tip of the blade, or alternatively, using a guide blade mounted in front of the doctor blade. The rubber sheet preceding the doctor blade isolates the water pond formed in front of the doctor blade from the surface of the roll, so that the rotational movement of the roll cannot induce turbulence and splashes.

11 Claims, 4 Drawing Sheets

6
2
7
3
5
1
11
4
10
9
8

ROLL CLEANING APPARATUS

BACKGROUND OF THE INVENTION

The present invention is related to an apparatus for cleaning a calender roll, coater backing roll or similar rolls.

DESCRIPTION OF THE PRIOR ART

Cleaning of coater backing rolls and calender rolls, particularly those of soft calenders has been necessary as long as such equipment has been in use. Dirt accumulates on the backing rolls as the coating mix penetrates the paper web during coating via the web pores and adheres onto the roll surface. The roll may also gather dirt as the coating mix finds access via holes in the base paper. Rolls of soft calenders accumulate adhering matter from dirt and coat dust carried over by the moving web and from areas of thick coats that have remained moist thus permitting their adherence on the roll surface. The penetration depth of the coating mix, and thus, its filtration through the web, is determined by the paper web porosity and thickness as well as the process conditions such as the application/doctor blade pressure and coating mix properties. With the modern trends of using a thin base web and a high coat weight, the coating mix is filtered in greater amounts through the base web which results in heavier dirt accumulation on the rolls than encountered before. A coat clump adhered to the roll becomes firmly fixed to the roll upon drying and then causes marks on the paper sheet. Paper quality degradation through marking obviously increases as the accumulation of dirt on the roll progresses.

Cleaning the rolls has in the prior art been performed by means of manual washing and doctoring with a doctor blade. Manual washing with a wetted sponge is clumsy and time consuming and requires heavy extensive labor. Due to high web speeds and greater tendency to dirt accumulation, the need for cleaning the rolls is frequent, since the rolls become dirty so rapidly. As the manual cleaning of the rolls is slow and accumulation of dirt is fast, manpower must be allocated on an almost continuous basis for cleaning. The work must be done carefully, because no water drippage from a sponge onto the running web is allowed and the operation must be performed while the equipment is running. As modern equipment is designed for high web speeds and wide webs, manual cleaning of long rolls is extremely awkward and dangerous.

Manual washing of rolls can be replaced by the use of doctor blades. Such an arrangement accomplishes dirt removal from roll surface with the help of a doctor blade. Water sprayed onto the roll prior to scraping is used to aid cleaning. Drawbacks of cleaning by doctoring include splashing of the doctored-away water, wear of the roll surface by the doctor blade and poor operation at high web speeds exceeding 10 m/s (600 m/min). Splashing results in an untidy working environment, and when water lands on the web, it spoils the paper sheet being processed. Owing to alignment tolerances between the roll to be cleaned and the doctor blade, the doctor blade imposes an uneven linear load on the roll which in turn, causes a high wear rate of both the blade and the roll. Due to the extremely stringent requirements set on the roll straightness, even the slightest wear of the roll leads to impairment of paper sheet quality, thus necessitating roll replacement. The change of the expensive roll combined with the mandatory equipment shutdown adds up to higher operating costs.

In cleaning with a doctor-blade, water splashing is chiefly caused by the accumulation of the washing water sprayed onto the roll into a pond in front of the doctor blade, where it is brought to a strongly vortical motion. The vortex is induced by the rotational movement of the roll, and the rotational direction of the vortex is upward along the doctor blade, that is, against the tangential speed of the roll. Besides splashing, the vortex induces vibrations in the doctor blade, whereby the blade allows water to pass under the blade. To avoid such water leak-through due to vibration, the blade loading must be increased which in turn leads to heavy wear of the doctor blade and the backing roll. All these problems are strongly accentuated at higher web speeds.

To avoid splashing and vortex build-up, two methods have chiefly been employed: water removal by suction from the front of the blade and water removal by blowing. Water can be vacuumed from the front of the blade by a suction manifold having branch pipes extending up to the pond formed in front of the blade. Alternatively, the water can be blown away using a similar manifold connected to the compressed-air network of the plant. These methods fail, however, to achieve satisfactory removal of water, and the blowing method in particular is hampered by the splashing of water even when using less vigorous blowing. As neither of these methods can successfully overcome the problems associated with manual washing and cleaning with a doctor blade, a doctor blade arrangement suited for high web speeds has not been available in the prior art.

In the light of the above-discussed, a modern roll cleaning method of higher practical usefulness is obviously needed.

SUMMARY OF THE INVENTION

It is an object of the present invention to achieve an apparatus capable of cleaning rolls in a coater and calender also in high-speed equipment at full operating speed.

The invention is based on adapting in front of the doctor blade, to the corner formed by the blade and the backing roll, a member with an elongated edge suited to isolate the water flow meeting the doctor blade surface from the roll surface thus preventing vortex formation.

More specifically, the apparatus according to the invention includes a member arranged to extend toward the corner between the doctor blade and the roll close to the nip between the roll and doctor blade. The member forms an edge that extends over the entire length of the doctor blade. The edge controls the flow of water hitting the doctor blade so that water backflow is guided away from the surface of the roll to thereby effectively prevent the backflow of the washing water onto the surface of the roll.

The backward vortex caused by the rotational movement of the roll can be entirely eliminated, whereby no problematic splashing occurs. Simultaneously, vibrations induced in the doctor blade by the vortical motion of the water can be avoided. Therefore, since no splashing occurs the roll cleaning apparatus can be run at very high web speeds. Blade loading can be reduced in an essential manner, which results in less wear and a reduced number of maintenance shutdowns. Water can be collected away via holes made in the doctor blade, thus improving its removal from the front of the blade. This offers the benefit that dirt detached from the roll need not be conveyed with a cross-directional water flow all the way along the side of the doctor blade to its end for removal thereof, thus avoiding the risk of permitting the dirt to enter the nip between the doctor blade and the roll. Further, only a limited volume of water remains in front of the blade and it can be easily removed by blowing at the end of the cleaning step, after which the roll cleaning apparatus can be lifted off the roll surface when the roll cleaning step is completed without involving any risk of permitting water to fall from the pond formed in front of the doctor blade onto the running web.

In addition to cleaning, the roll cleaning apparatus can be used for cooling the soft rolls of a soft calender and moistening of a running web by water dosed onto the doctor blade of a calender roll.

In the following the invention is described in greater detail with reference to the annexed drawings.

DETAILED DESCRIPTION OF THE PREFERRED EMBODIMENTS

Figure 1:
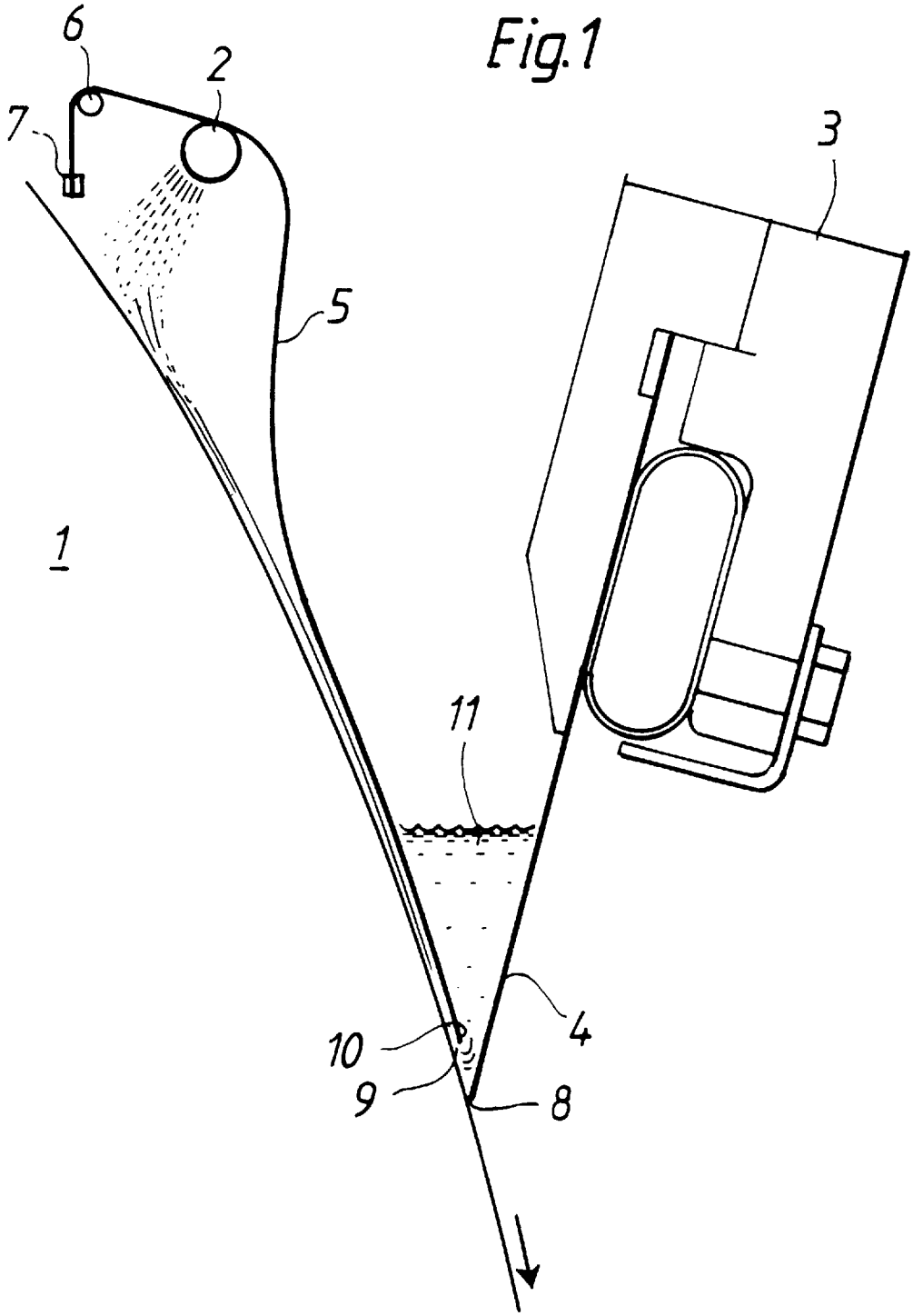
FIG. 1 is a diagrammatic cross-sectional view of an embodiment of the apparatus according to the invention.

With reference to the embodiment shown in FIG. 1, the cleaning apparatus comprises a conventional doctor blade 4 arranged by means of a blade holder 3 to rest against a roll 1 to be cleaned, and a water spray pipe 2 adapted in front of the doctor blade 4 as seen in the rotational direction of the roll 1. In this embodiment the vortical motion of washing water is prevented by means of a rubber sheet 5. The rubber sheet 5 extends in front of the water spray pipe 2 where it is stretched over a support bar 6 and tensioned by weights 7 attached to this edge 10. The other edge hangs downwardly so as to reach down to a point in front of the water spray pipe 2 to effectively prevent air conveyed by the rotating roll 1 from disturbing the washing water spray. On the side close to the doctor blade 4 from the water spray pipe 2, the rubber sheet 5 rests on the roll 1 and extends close to the scraping nip 8 between the roll 1 and the doctor blade 4.

When water is sprayed onto the roll 1 to be cleaned, the water travels into the nip between the roll 1 and the rubber sheet 5, whereby the rubber sheet 5 is elevated on a water foil. The water foil acts as an efficient lubricant in the nip, thus making the wear of the rubber sheet 5 minimal. When the water carried over by the rotation of the roll 1 reaches the edge 10 of the rubber sheet 5, the water is forced through the narrow slot 9 between the doctor blade 4 and the rubber sheet 5 and rises up forming a pond 11 in front of the doctor blade 4 as the doctor blade 4 prevents the water from exiting the pond 11. As the rubber sheet 5 now isolates the water contained in the pond 11 with the exception of the narrow slot 9 formed against the roll 1, the rotational movement of the roll 1 is prevented from acting on the water contained in the pond 11, whereby the vortex effect is avoided. In this embodiment, the water accumulated in front of the blade 4 is removed in a conventional manner at the ends of the roll 1.

Figure 2:
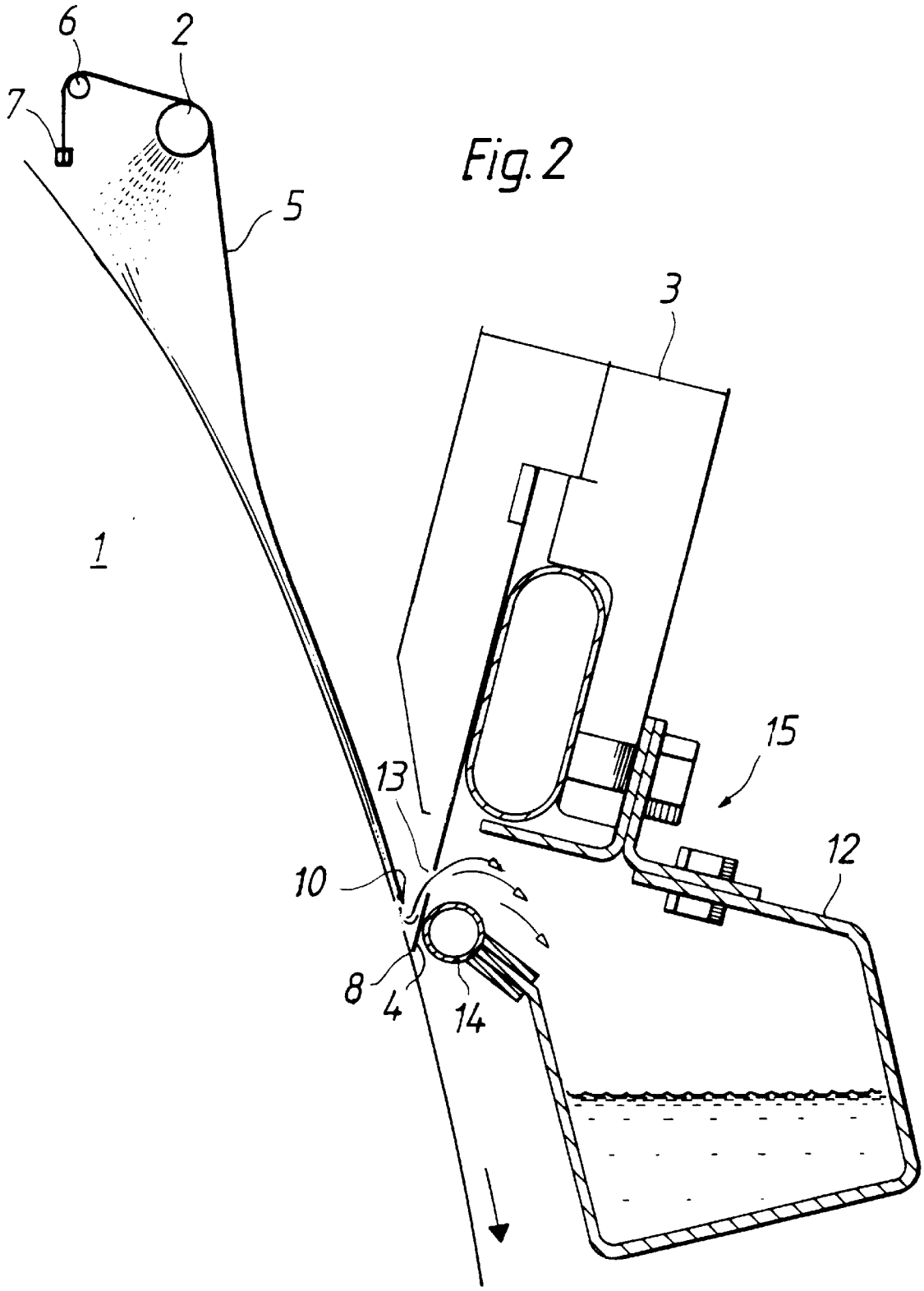
FIG. 2 is a diagrammatic cross-sectional view of another embodiment of the apparatus according to the invention.

With reference to FIG. 2, an alternative embodiment of the invention is shown. Also in this embodiment the splashing of the water is prevented with the help of a rubber sheet 5 extending close to the nip 8 between the blade 4 and the roll 1. However, the method for accumulating the roll washing water is herein different. The doctor blade 4 is provided over its entire length with holes 13 and a water collection reservoir 12 is adapted to the rear side of the doctor blade. The pool reservoir is connected by means of a bolt attachment 15 to the blade holder 3 and the pool reservoir edge is sealed against the rear side of the doctor blade 4 by means of a rubber seal 14. When the water rises up in front of the doctor blade 4, it can immediately flow away via the holes 13 to the rear side of the doctor blade .4 into the water collection reservoir 12, wherefrom it is easily removed at the ends of the roll 1. This arrangement achieves fast removal of water from the front of the blade 4 thus permitting rapid removal of dirt detached from the surface of the roll 1. In this manner the risk of dirt entry into the nip between the doctor blade 4i. and the roll 1 is reduced in an essential manner. Water removal from the reservoir 12 is easier that of the first embodiment adapted at the ends of the roll 1 and the splashing is further significantly reduced. Moreover, this construction permits the seal 14 to be an air hose, whereby the loading of the doctor blade 4 can be arranged close to its tip by controlling the pressure in the air hose 14.

Figure 3:
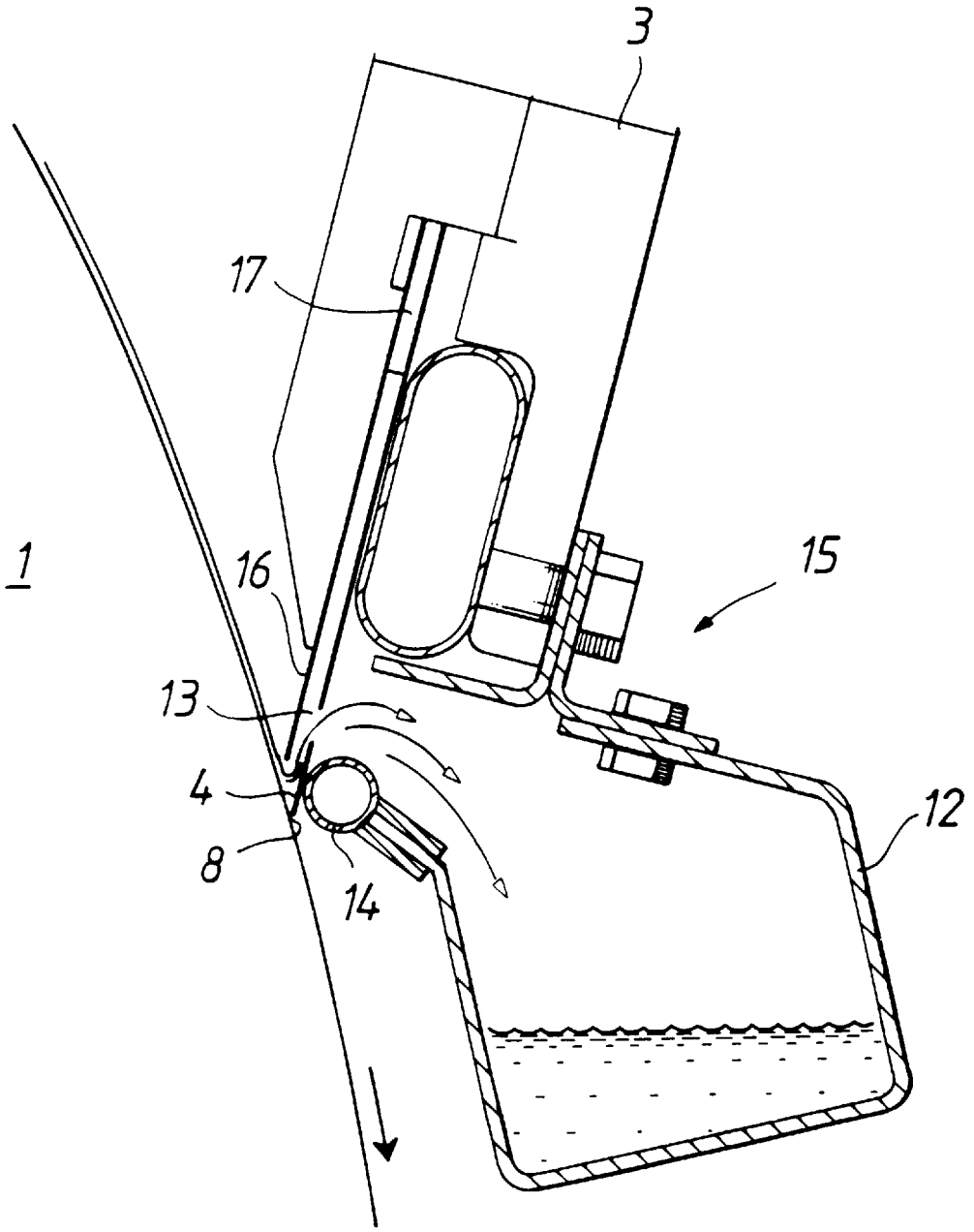
FIG. 3 is a diagrammatic cross-sectional view of third embodiment of the apparatus according to the invention.

In the embodiment shown in FIG. 3, the rubber sheet 5 is replaced by a guide blade 16 arranged in front of the doctor blade 4. The guide blade 16 is attached to the same blade holder 3 as the doctor blade 4 proper. The blade holder 3 has a slab 17 placed between the doctor blade 4 and the guide blade 16 to separate the blades from each other. Thus, the guide blade 16 is situated at a distance in front of the doctor blade 4. In the radial direction of the roll 1, the guide blade 16 extends close to the roll 1, yet leaving a clear gap between the guide blade 16 and the roll 1 so that the guide blade 16 cannot touch the roll 1. Water collection also in this embodiment occurs via holes 13 of the doctor blade 4 into a collection reservoir 12.

As the washing water running on the roll 1 hits the doctor blade 4, the water naturally tends to rise upward along the front side of the doctor blade 4. However, the guide blade 16 prevents the water from flowing backward, whereby the water is compelled to enter the slit between the doctor blade 4 and the guide blade 16. From this slit the water flows via the holes 13 of the doctor blade 4 into the collection reservoir 12. Hence, in this embodiment the water is guided directly away from in front of the doctor blade, whereby the formation of a pond with a vortex is entirely eliminated.

Figure 4:
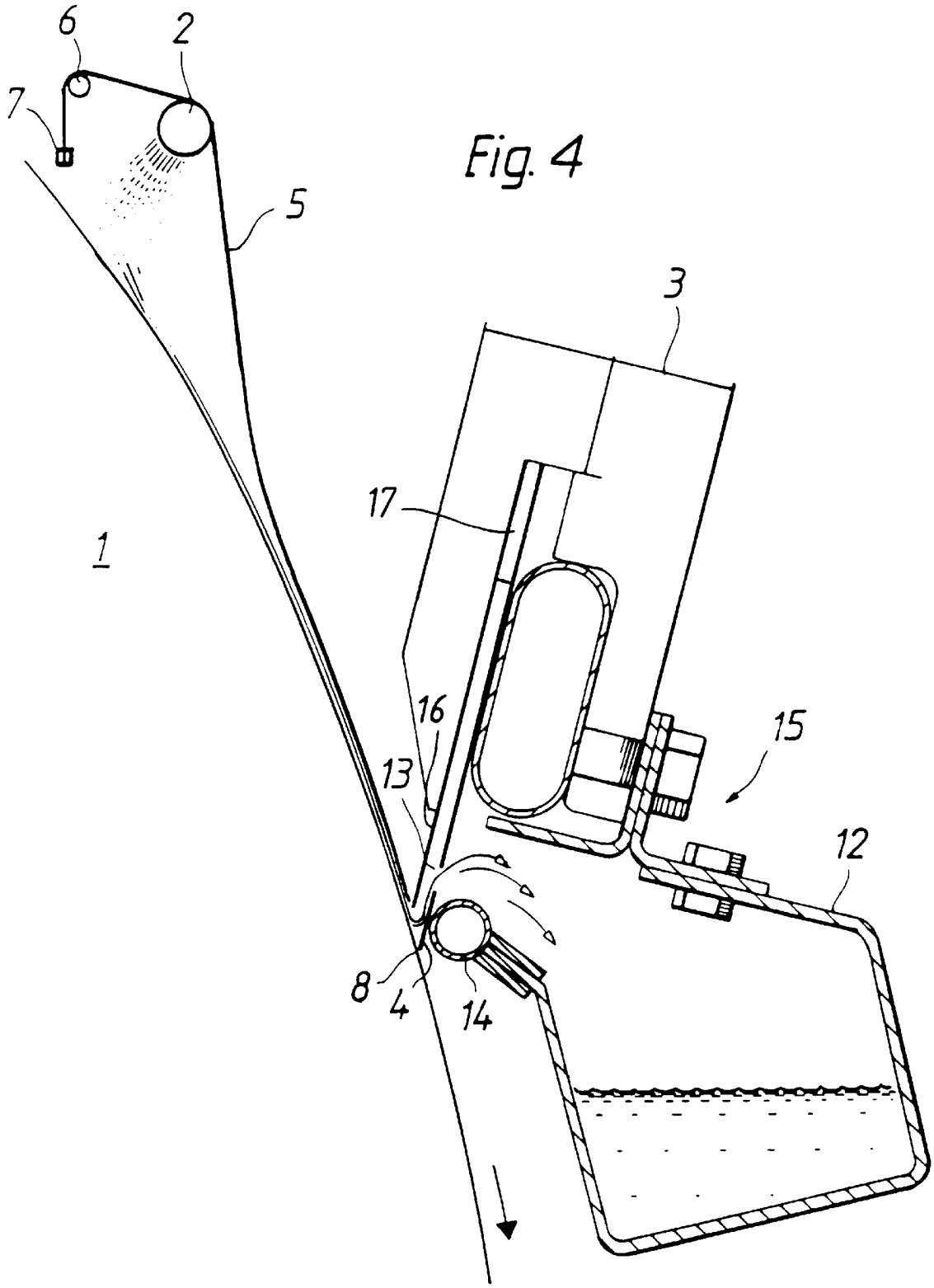
FIG. 4 is a diagrammatic cross-sectional view of a fourth embodiment of the apparatus according to the invention.

Besides those described above, the present invention can have alternative embodiments. For instance, as shown in FIG. 4, both the rubber sheets and the guide blade 16 can be included in a single washing apparatus, whereby the splashing is minimized as the entry of air to the washing zone can be prevented. The location of the rubber sheet edge and the guide blade edge relative to the doctor blade is not critical, whilst the gap 9 between the rubber sheet edge and the doctor blade should be kept smaller than from 15 mm to 10 mm, for instance. The gap-between the doctor blade 4 and the guide blade 16 is most advantageously approx. 2–3 mm wide, and-the distance of the guide blade edge from the roll 1 is approx. 2–5 mm. Particularly the attitude of the guide blade 16 relative to the doctor blade 4 must be easily adjustable. The guide blade 16 can be aligned to any desirable angle in the corner formed between the doctor blade 4 and the roll 1 provided that the rotational movement of the roll 1 is prevented from inducing a vortical motion in the water accumulated in front of the doctor blade. If the guide blade 16 is aligned at an acute angle relative to the doctor blade 4, a water collection pool can be formed between the blades and the accumulated water can be removed therefrom at the ends of the roll 1, or alternatively, vacuumed away by means of a suction pipe.

Besides a guide blade 16 and a rubber sheet, obviously any other kind of member can be used which is suited for forming such an edge in the corner between the doctor blade 4 and the roll 1 that can prevent the water flow, which hits against the doctor blade 4, from flowing back against the roll surface. Instead of a water spray pipe, the washing water can be ejected from different kinds of spray nozzles and other dosing arrangements.

What is claimed is:

1. An apparatus for cleaning a roll surface, comprising:

a blade holder;

a doctor blade attached to the b lade holder;

a means for adjustably pressing the doctor blade against the surface of the roll to be cleaned;

a water feeding means, arranged in front of the doctor blade relative to a rotational direction of the roll, for feeding washing water to the surface of the roll; and a flow control means for forming an edge close to a point where the roll contacts the doctor blade, said edge extending over an entire length of the doctor blade, said edge being arranged and adapted to control a flow of water hitting the doctor blade whereby water back flow is guided away from the surface of the roll to effectively prevent the back flow of washing water onto the surface of the roll.

2. The apparatus of claim 1, wherein the flow control means includes a rubber sheet arranged to extend parallel to the surface of the roll close to the doctor blade to define the edge.

3. The apparatus of claim 2, wherein the water feeding means includes a water spray pipe having a front side relative to the rotational direction of the roll, the rubber sheet being arranged and adapted to extend over the water spray pipe to the front side of the pipe and downward near the surface of the roll so that the rubber sheet prevents air from entering a zone where the washing water is fed to the roll surface.

4. The apparatus of claim 3, wherein the rubber sheet is arranged so that a maximum distance of the edge of the rubber sheet from the doctor blade is less than 15 mm.

5. The apparatus of claim 2, wherein the flow control means includes a guide blade arranged adjacent to the doctor blade so as to form a gap between the doctor blade and the guide blade, whereby the guide blade guides water hitting the doctor blade to flow into the gap.

6. The apparatus of claim 2, wherein the rubber sheet is arranged so that a maximum distance of the edge of the rubber sheet from the doctor blade is less than 15 mm.

7. The apparatus of claim 1, wherein the flow control means includes a guide blade arranged adjacent to the doctor blade so as to form a gap between the doctor blade and the guide blade, where by the guide blade guides water hitting the doctor blade to flow into the gap.

8. The apparatus of claim 7, wherein the guide blade is arranged to be parallel to the doctor blade.

9. The apparatus of claim 8, wherein the gap between the doctor blade and the guide blade is approximately 2–3 mm wide, the guide blade being arranged so that a front edge of the guide blade is approximately 2–5 mm from the roll surface.

10. The apparatus of claim 1, wherein the doctor blade has holes therein to permit water to pass therethrough, and further comprising a water collection reservoir arranged behind the doctor blade to collect water passing through the holes.

11. The apparatus of claim 10, and further comprising an air hose arranged at a sealing line between the doctor blade and the water collection reservoir, whereby load control of the doctor blade can be accomplished by adjusting air pressure in the air hose.

* * * * *

UNITED STATES PATENT AND TRADEMARK OFFICE

CERTIFICATE OF CORRECTION

PATENT NO : 5,848,452

DATED : December 15, 1998

INVENTOR(S) : Teuvo Lappalainen

It is certified that error appears in the above-identified patent and that said Letters Patent is hereby corrected as shown below:

Delete "Timo Vuorimies" as an inventor.

Signed and Sealed this

Eighteenth Day of May, 1999

*Attest:*

Q. TODD DICKINSON

*Attesting Officer*

*Acting Commissioner of Patents and Trademarks*